US005243844A

United States Patent [19]

Lisec

[11] Patent Number: 5,243,844

[45] Date of Patent: Sep. 14, 1993

[54] PROCESS FOR PRODUCING CURVED SECTIONS IN HOLLOW PROFILE STRIPS

[76] Inventor: Peter Lisec, Bahnhofstrasse 34, A-3363 Amstetten-Hausmening, Austria

[21] Appl. No.: 942,114

[22] Filed: Sep. 2, 1992

Related U.S. Application Data

[63] Continuation of Ser. No. 701,876, May 17, 1991, abandoned.

[30] Foreign Application Priority Data

| | | | |
|---|---|---|---|
| May 21, 1990 | [AT] | Austria | 1126/90 |
| Sep. 10, 1990 | [AT] | Austria | 1840/90 |
| Oct. 2, 1990 | [AT] | Austria | 1987/90 |

[51] Int. Cl.[5] ..... B21D 7/08; B21D 53/74

[52] U.S. Cl. ..... 72/168; 72/171; 72/307

[58] Field of Search ..... 72/168, 177, 171, 172, 72/173, 175, 307

[56] References Cited

U.S. PATENT DOCUMENTS

| | | | |
|---|---|---|---|
| 359,263 | 3/1887 | Kollenberg | 72/172 |
| 473,455 | 4/1892 | Fowler | 72/172 |
| 1,692,400 | 11/1928 | Auble | 72/175 |
| 1,807,847 | 6/1931 | Kellogg | 72/168 |
| 2,087,721 | 7/1937 | Kellogg | 72/171 |
| 2,264,507 | 12/1941 | Burger | 72/172 |
| 3,076,491 | 2/1963 | Bruderlin | 72/171 |
| 3,563,283 | 2/1971 | Tufektshiev | 72/307 |
| 3,788,116 | 1/1974 | Fazzani | 72/318 |
| 3,823,749 | 7/1974 | Ritter | 72/307 |
| 4,462,237 | 7/1984 | Kauferle | 72/307 |
| 4,624,121 | 11/1986 | Kitsukawa | 72/307 |
| 5,104,026 | 4/1992 | Sturrus | 72/168 |

FOREIGN PATENT DOCUMENTS

| | | | |
|---|---|---|---|
| 360311 | 1/1981 | Austria . | |
| 875354 | 7/1971 | Canada | 72/307 |
| 0121873 | 10/1984 | European Pat. Off. . | |
| 0318748 | 6/1989 | European Pat. Off. . | |
| 3436285 | 4/1985 | Fed. Rep. of Germany | 72/307 |
| 87057964 | 7/1987 | Fed. Rep. of Germany . | |
| 3807529 | 9/1989 | Fed. Rep. of Germany . | |
| 494898 | 8/1981 | U.S.S.R. | 72/168 |
| 266876 | 3/1927 | United Kingdom | 72/172 |
| 2114201 | 8/1983 | United Kingdom . | |
| 8909104 | 10/1989 | World Int. Prop. O. | 72/307 |

OTHER PUBLICATIONS

"Wallace Spacer Bender" Brochure by Wallace Benders Corporation, Chicago, Ill., 1985.

*Primary Examiner*—Daniel C. Crane

*Attorney, Agent, or Firm*—Young & Thompson

[57] ABSTRACT

In order to curve a hollow profile strip (53), especially a hollow profile strip (53) from which a spacer frame for an insulating glass pane is to be produced, the hollow profile strip (53) is conducted continuously for an exactly defined length, held laterally and from the bottom, underneath a roller (70) and, subsequently to the roller (70), is deflected out of the conveying direction. An apparatus suitable for this purpose comprises a gripper (52) for the defined feeding of the hollow profile strip (53), a roller (70) in contact with the wall of the hollow profile strip (53), which is then located on the inside of the curvature, and holding down the hollow profile strip (53), and a lever (59) with a stop surface (62) for the hollow profile strip (53) subsequently to the roller (70). By selecting the extent of feeding of the hollow profile strip (53) and by the extent of deflection of the same, the length and/or the radius of curvature of the curved section (71) of the hollow profile strip (53) can be determined.

5 Claims, 14 Drawing Sheets

PROCESS FOR PRODUCING CURVED SECTIONS IN HOLLOW PROFILE STRIPS

Figure 1:
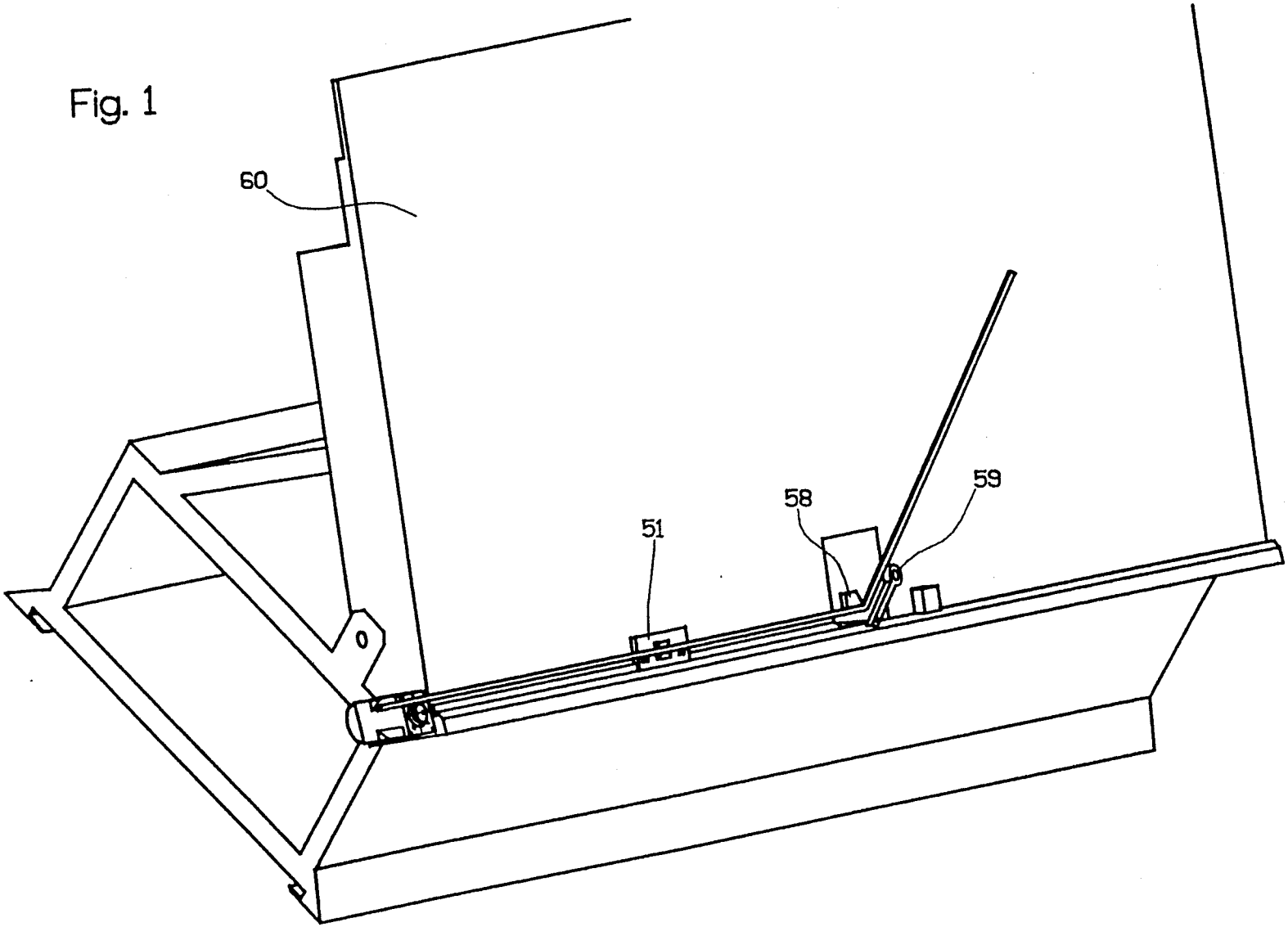

This application is a continuation of application Ser. No. 07/701,876, filed May 17, 1991, now abandoned.

The invention relates to a process for the production of curved sections in hollow profile strips.

Spacer frames made of one piece with more or less sharply-edged bent corners, consisting of hollow profile strips, as well as devices for manufacturing same have been known from German Utility Model 8,705,796, German Patent 3,221,881, U.S. Pat. No. 4,836,005, French Patent 2,449,222, and DOS 3,221,986.

Also, attention is invited to DOS 3,312,764 from which it is known to bend hollow profile strips into spacers for insulating glass panes wherein a mandrel that can be placed from the inside against the hollow profile strip is provided in the region of the bending site. Bending takes place by pivoting of a jaw wherein the other end of the profile strip is clamped between a movable clamping jaw and an abutment in contact with the inside of the profile strip.

One problem in the known bending devices resides in that the sharp-edged bends required for use in insulating glass panes cannot always be obtained without problems inasmuch as there is the danger, in part, that the walls of the hollow profile strip will develop tears during the bending step, and the lateral surfaces of the hollow profile strips do not always extend in planar fashion in the corner zone, i.e. at the location where they have been bent, but rather exhibit undulations which interfere with and impede the subsequent processing of the spacer frame, especially the coating of the lateral surfaces of the spacer frames with sealing compound or adhesive.

DAS 2,128,717 discloses a process for the application of a metallic spacer to the pane rims of one of the rectangular glass plates of an insulating glazing. In this process, the spacer is brought into contact continuously with a pane-parallel surface against a first pane rim of the horizontally disposed glass plate and is then attached. Thereafter, the spacer is brought into contact with a pane-parallel surface against the subsequent pane rim and attached. These operating steps are repeated until the spacer frame has been mounted to all pane rims. Thereupon, the spacer is cut off and its ends are joined. In this procedure, the glass pane, after attaching the spacer at a pane rim, but before it is pivoted, is shifted in parallel to this pane rim, by a distance corresponding to the length of this pane rim; the pivoting of the glass plate takes place in each case about an identical predetermined pivot axis; and the spacer is bent about this pivot axis. In this process, the spacer is initially arranged only along a portion of the length of the first pane rim, and the spacer, after it has been attached along the pane-parallel surface of the last pane rim, is cut off with an excess length. Only then is the excess portion bent by 90° about the pivot axis of the glass pane and attached to the glass pane.

It has been known from EP-A-332,049 to bend hollow profile strips into spacers for insulating glass panes. According to EP-A-332,049, the profile is advanced during the bending step, and a bending tool is moved in oscillating fashion toward the abutment and away from the latter; during the moving away of the bending tool, the profile is advanced and during the subsequent movement of the bending tool toward the abutment a neighboring site of the profile with respect to the previously bent site is acted upon and bent. Thereby, depending on the feeding speed of the profile and the bending frequency or the bending stroke of the bending tool, varying arcs and radii of curvature can be generated. However, the results are not arcs of a constant curvature but rather sections of the hollow profile strip which are repeatedly angled.

Also conventional are bending machines for hollow profile rods which are equipped with rolls. Thus, DOS 3,034,436 describes a roll bending machine exhibiting three rolls, the hollow profile rod being held by two rolls in contact with the third roll. The radius of curvature in the hollow profile rod corresponds to the radius of the third roll about which the hollow profile rod has been bent.

It is likewise known from U.S. Pat. No. 3,885,412 to continuously bend a hollow profile rod by moving the latter through an arrangement of three rolls. The hollow profile rod, in U.S. Pat. No. 3,885,412, is moved between two rolls while it is stressed by the third roll, arranged in front of the pair of rolls with respect to the direction of movement of the rod, so that it is bent during passage between the rolls of the roll pair. The roll on the inlet side can be adjusted so that varying curvatures can be produced.

Both conventional devices operate exclusively with rolls, the deflection being likewise effected by a roll. It is not possible by means of the known devices to manufacture spacer frames comprising bent and straight sections as well as optionally at least one corner.

It is an object of this invention to provide a process and an apparatus making it possible to produce continuously curved hollow profile strips wherein the radii of curvature and the length of the curved section of the hollow profile strip can be selected extensively arbitrarily.

This object has been attained in a process of the type discussed hereinabove by advancing the profile under a hold-down between guide jaws, supported from below, and by deflecting the profile, downstream of the hold-down, out of the conveying direction of the hollow profile strip.

As compared with the mode of operation of previously known bending devices, the process of this invention displays considerable advantages. Thus, differently from EP-A-332,049, it is possible to produce continuously (steadily) curved sections.

As compared with the mode of operation known from DOS 3,034,436 and U.S. Pat. No. 3,885,412, it is advantageous in the invention that the radius of curvature and/or the length of the curvature can be adjusted in a very simple way. A further advantage resides in the proposal according to this invention to provide deflection with the aid of a stop surface instead of, as known, by means of rollers, especially in view of the fact that the stop surface, as part of the pivotable bending lever, can then be readily adjusted to the desired angle of deflection.

It is beneficial to the success of the process according to the invention if the hollow profile strip to be curved is advanced by a feeding device advantageously designed as a gripper or comprising a gripper. This eliminates, on the one hand, drive mechanisms for the rollers, as needed for the conventional devices, and offers the advantage, as compared with pulling the hollow profile strip, that curved or bent zones (corners) produced in the latter are not again deformed.

Advantageous embodiments of the process according to this invention and devices suitable for performing the process constitute the subject matter of the dependent claims.

In the process of this invention, the hollow profile strip to be bent into the spacer frame is advanced by the feeding device (gripper) during the bending step exactly by the required distance which corresponds, for example, to the respective curved section of the spacer frame. In case the length of the curved section is larger than the maximum stroke of the gripper, the profile strip is advanced in two or, if need be, more than two steps. The procedure can be such that the first (or the initial) stroke (strokes) correspond to a predetermined length (the maximum stroke), and the final stroke is adapted to the required length of the curved frame section.

Figure 2:
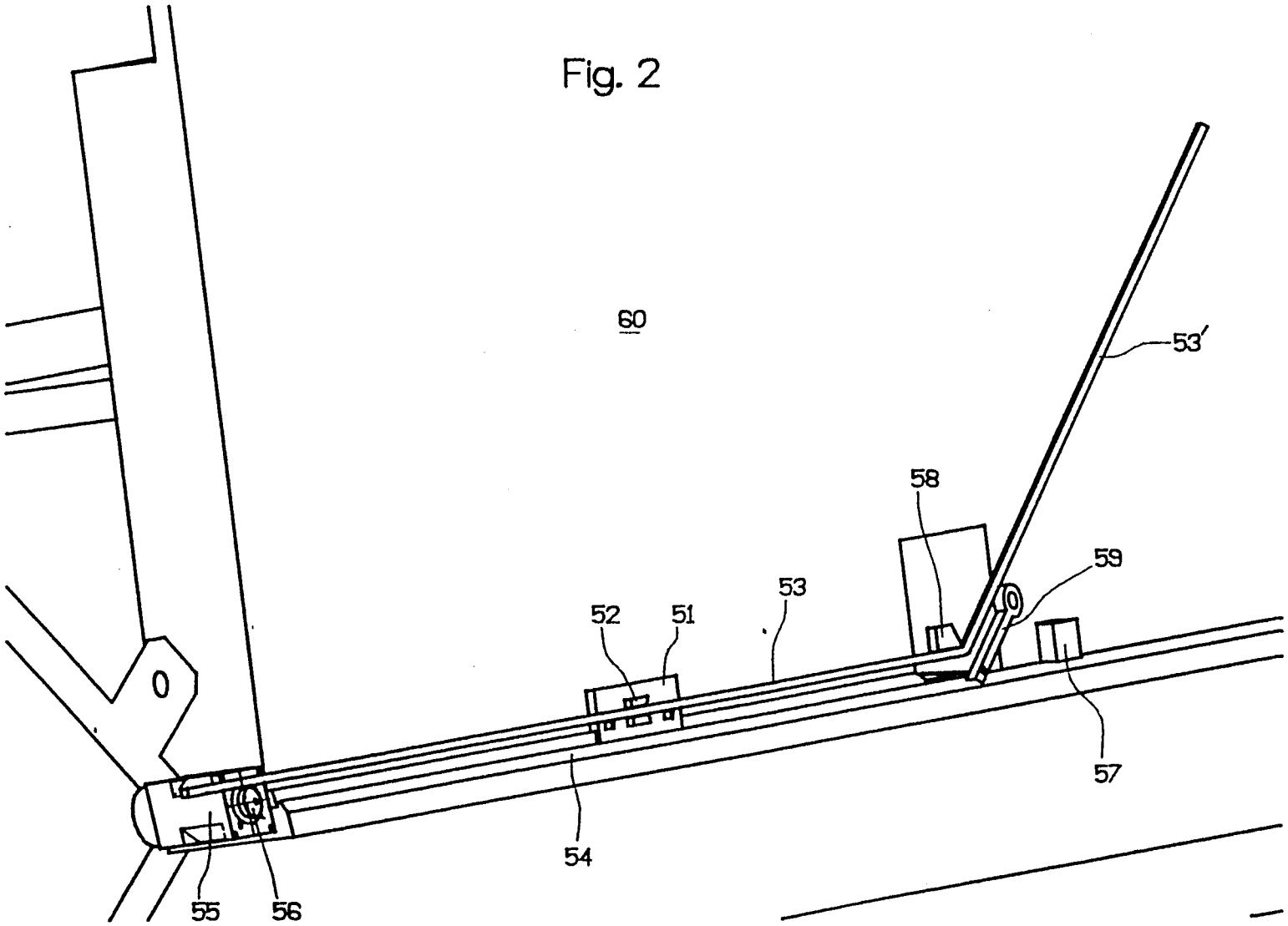
Figure 3:
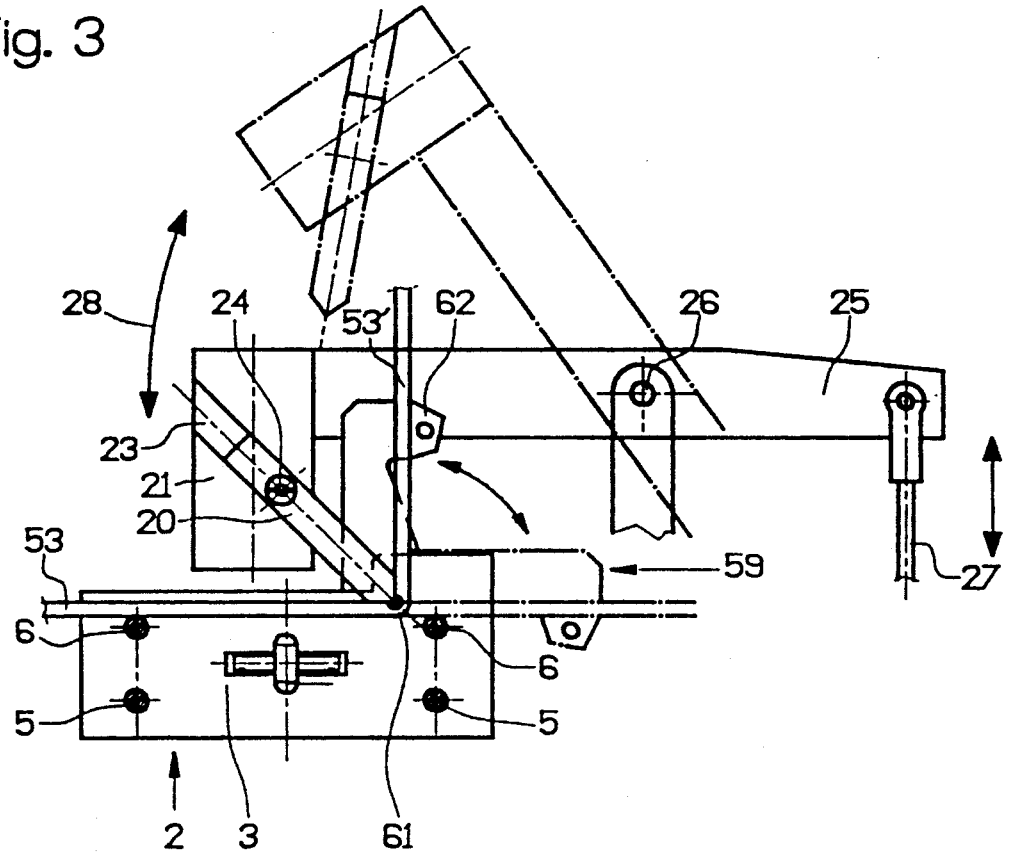
Figure 4:
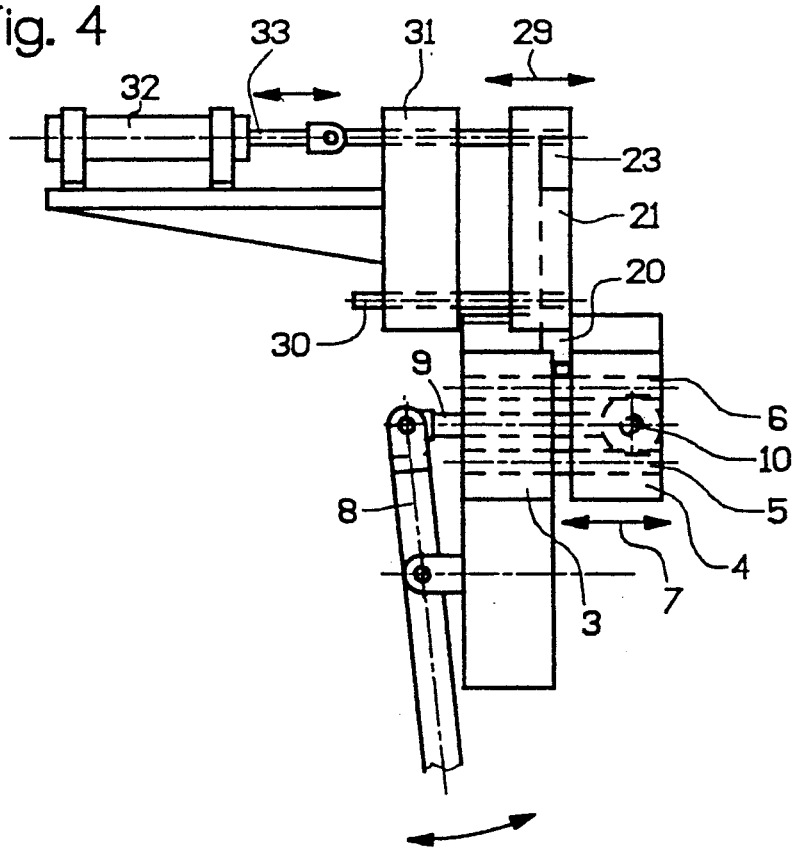
Figure 5:
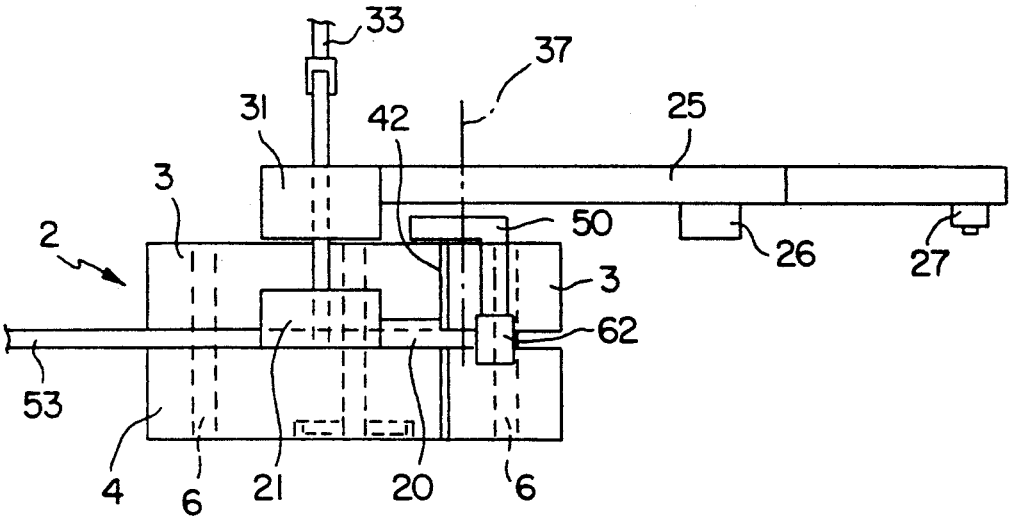
Figure 6:
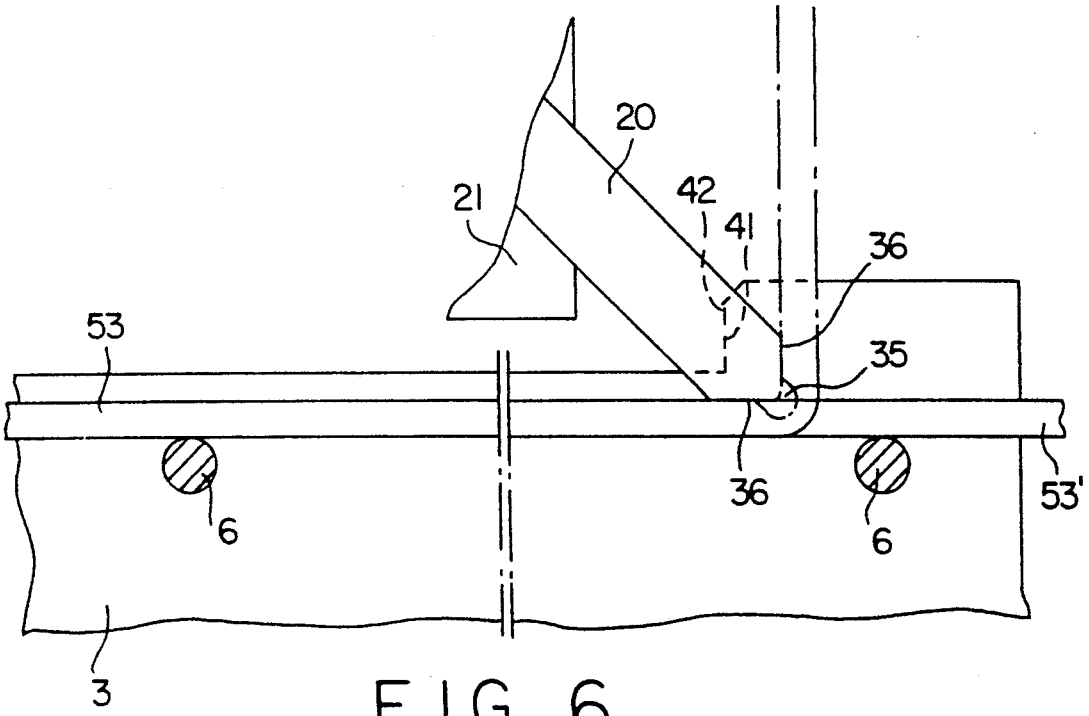
Figure 7:
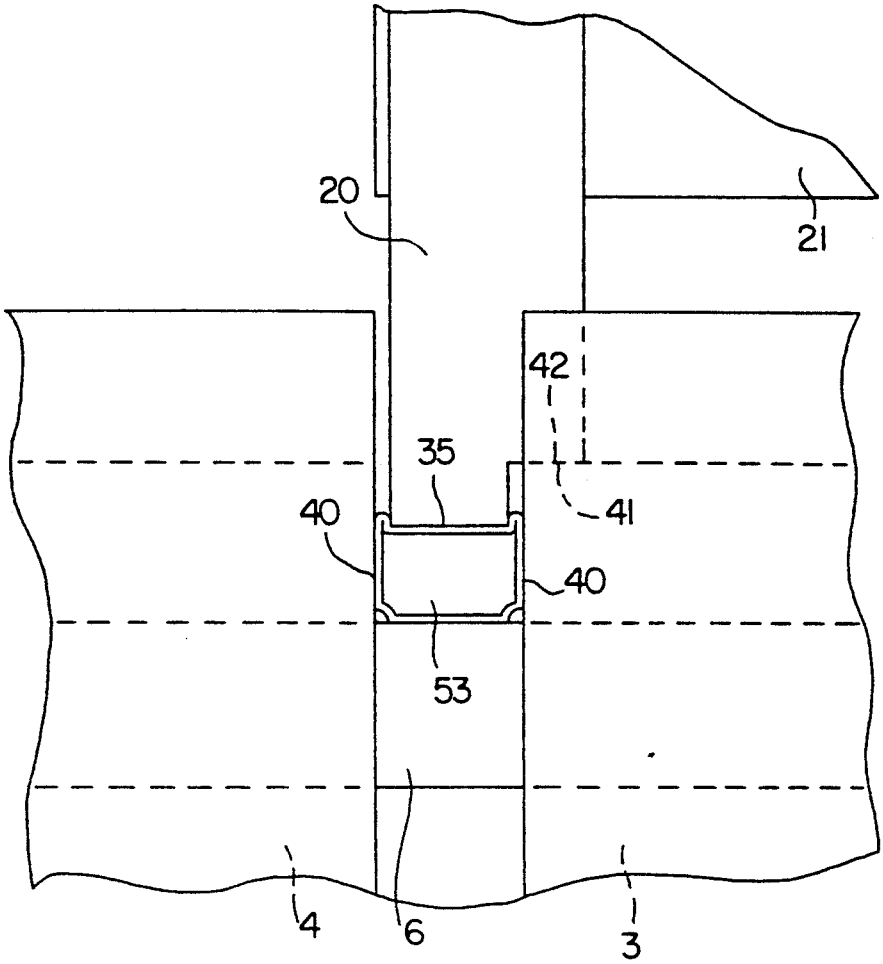
Figure 8:
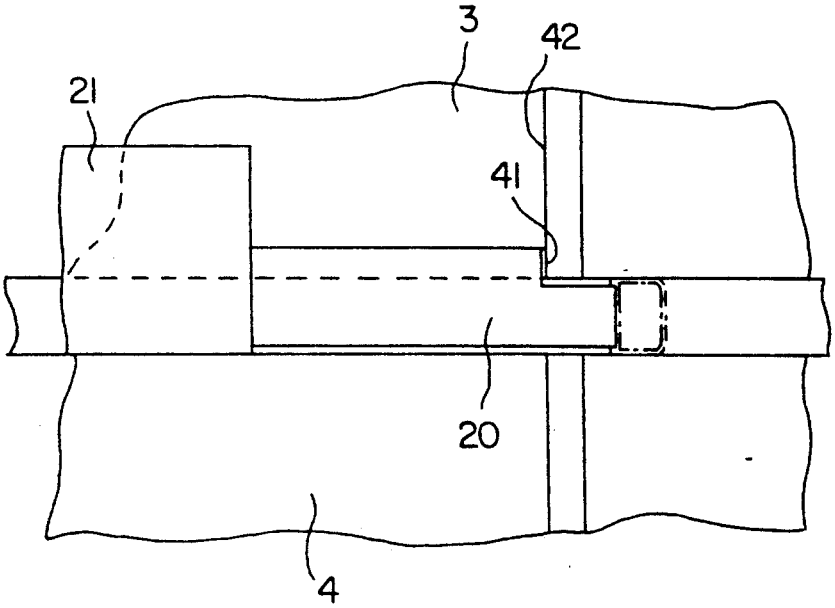
Figures 9A, 9B, 9C, 9D, 9E, 9F:
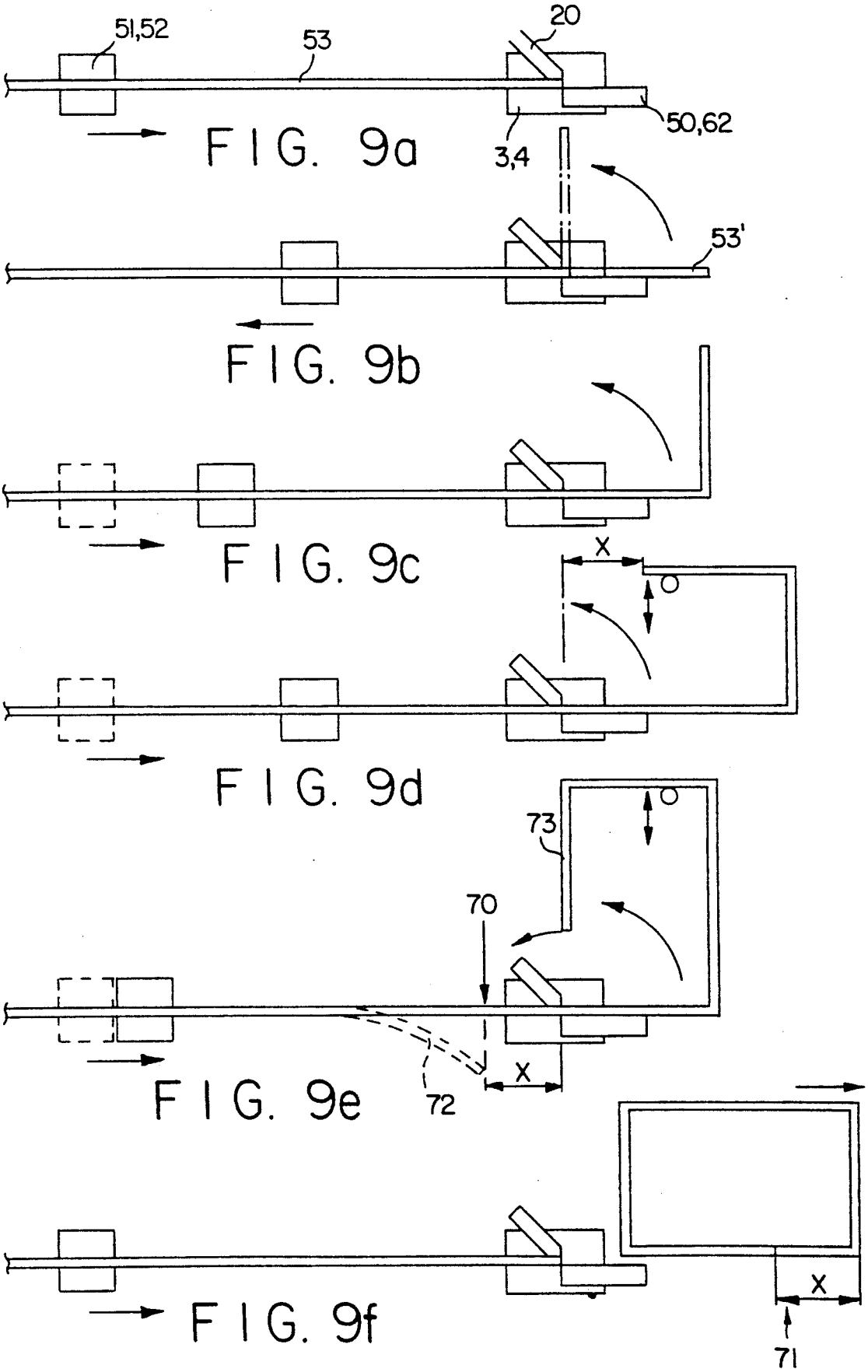
Figure 10:
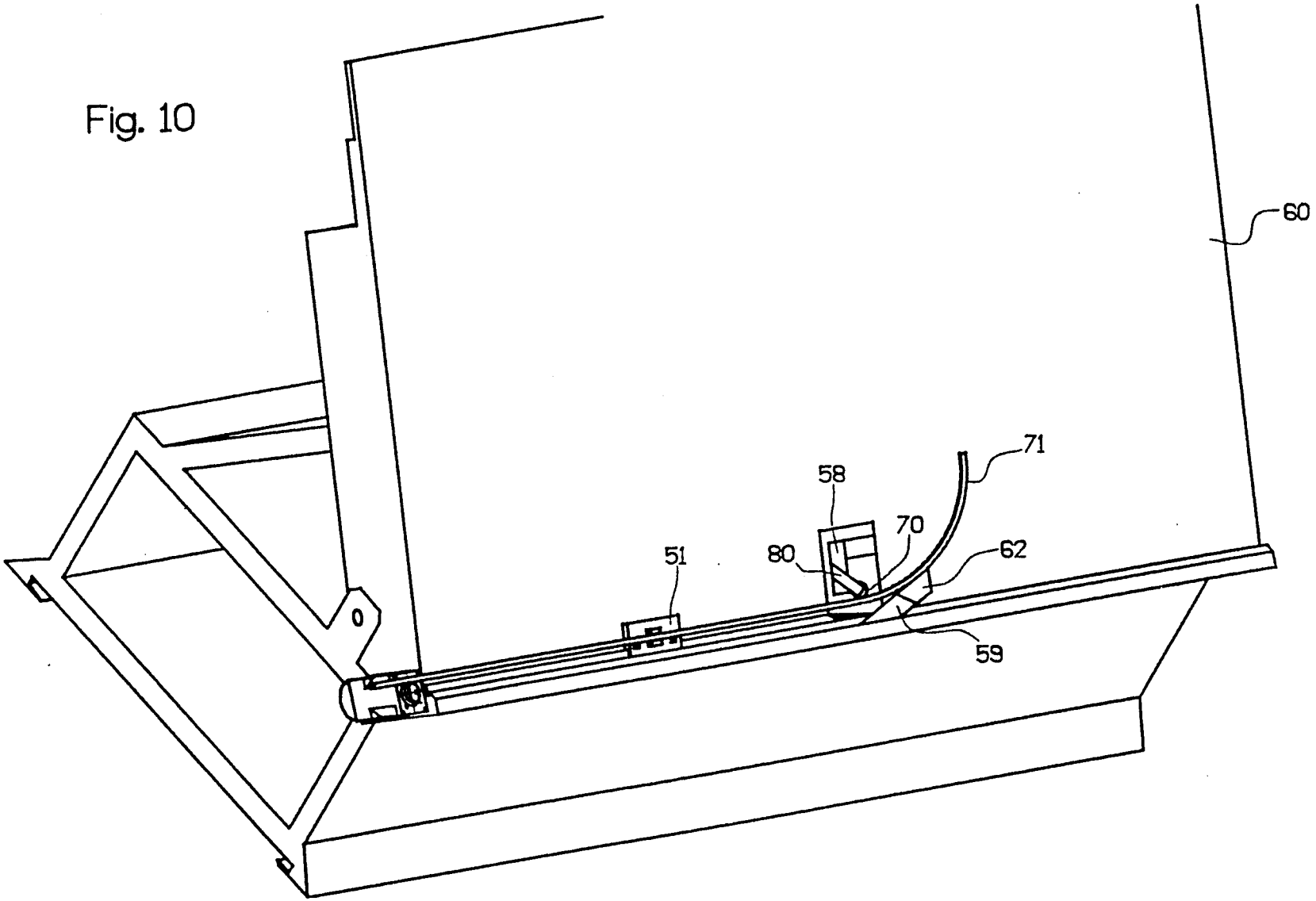
Figure 11:
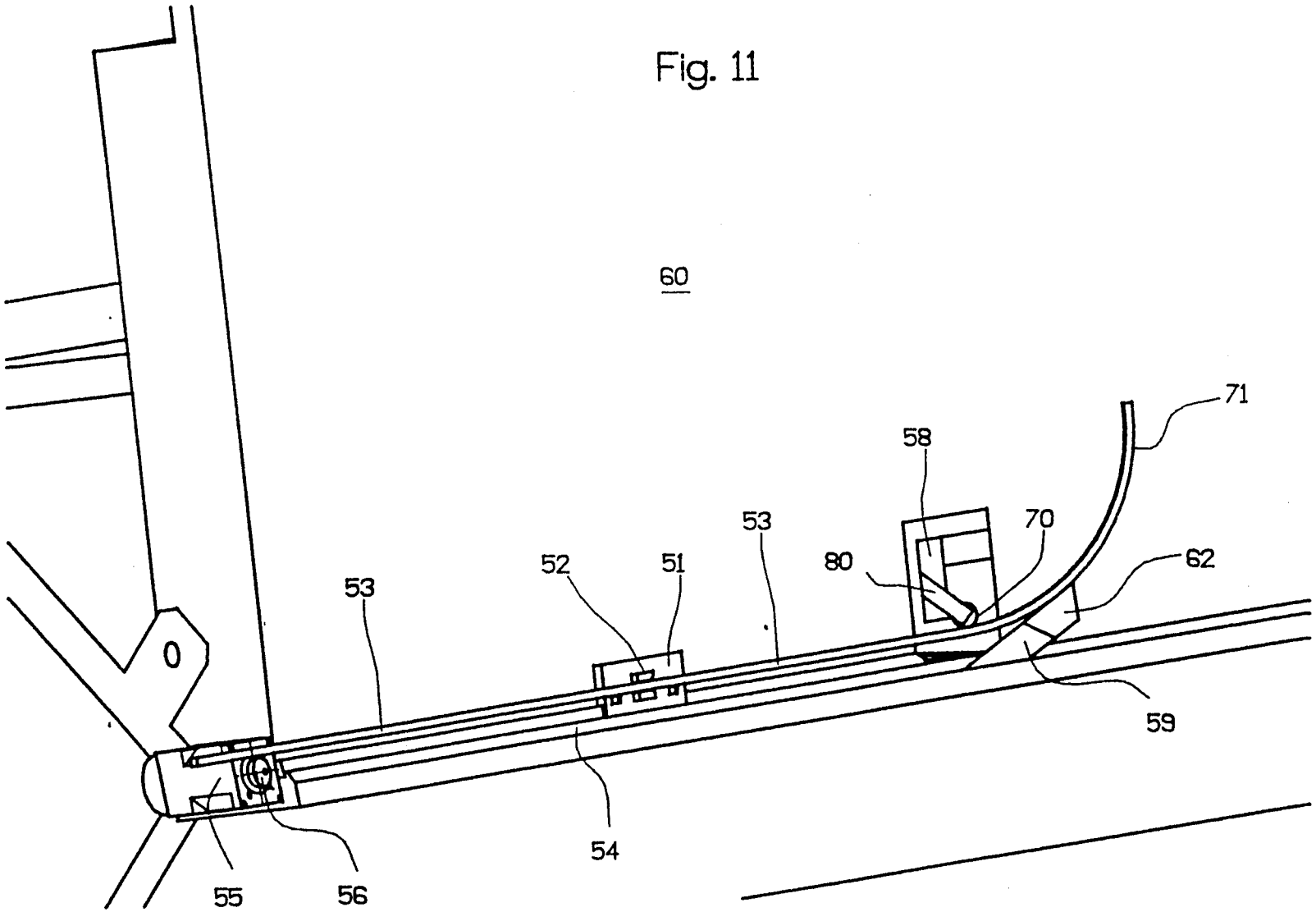
Figure 12:
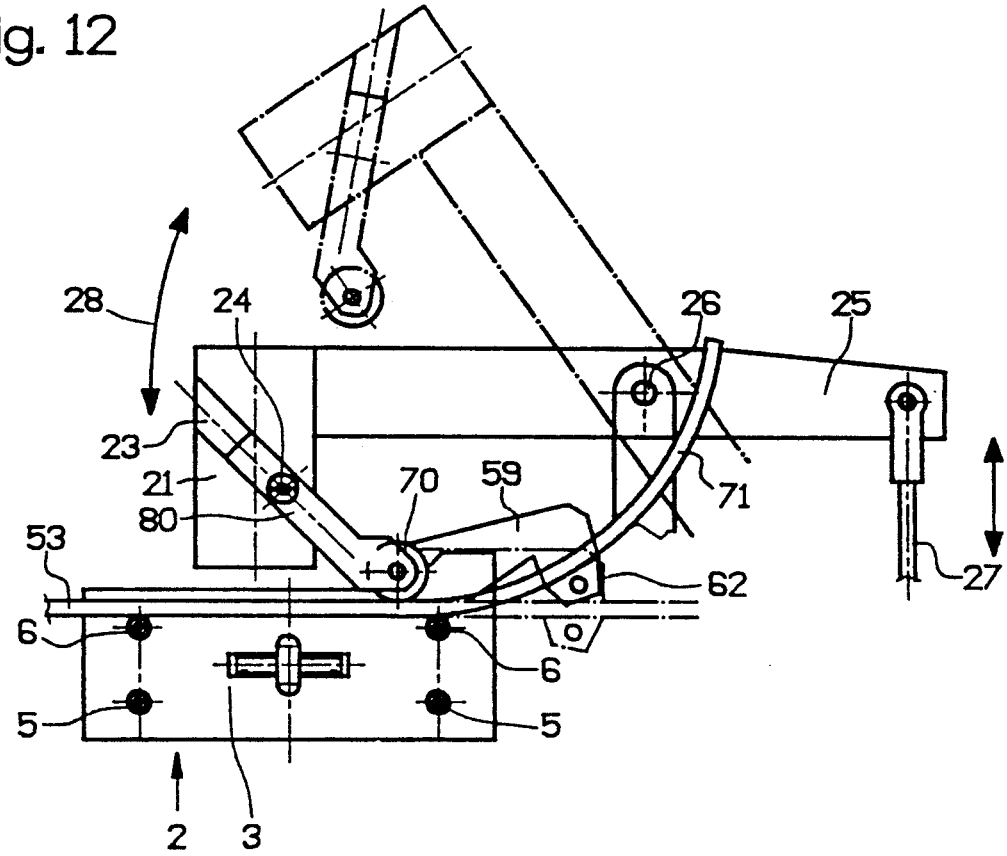
Figure 13:
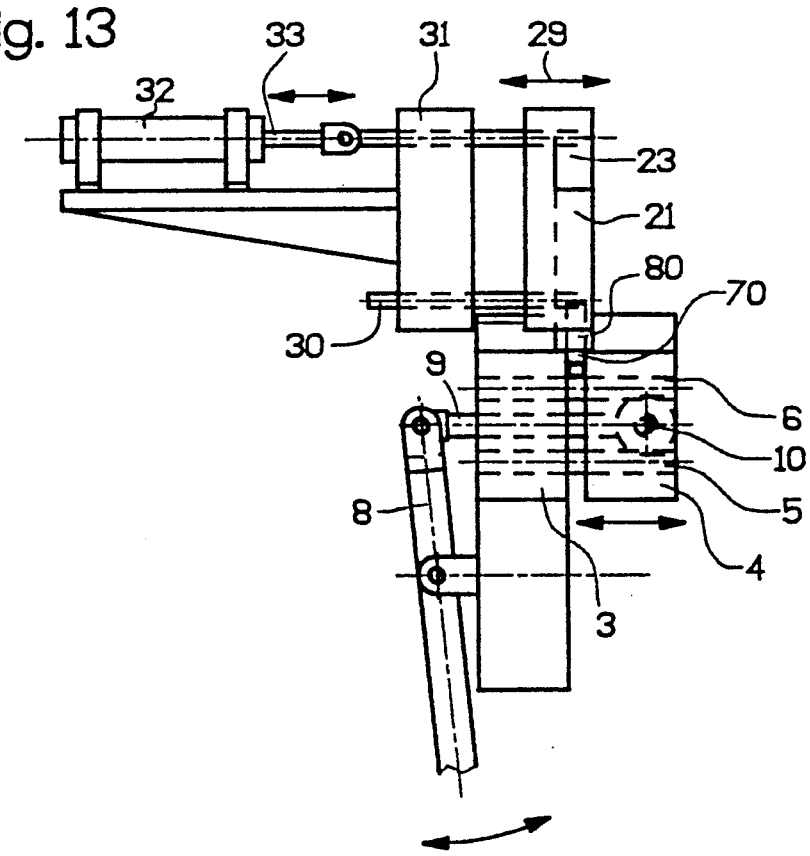
Figure 14:
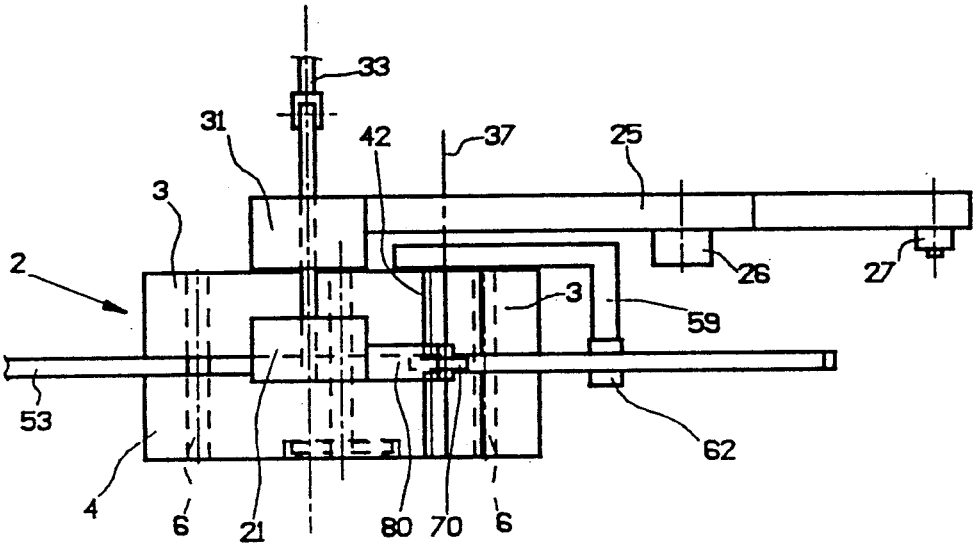
Figure 15:
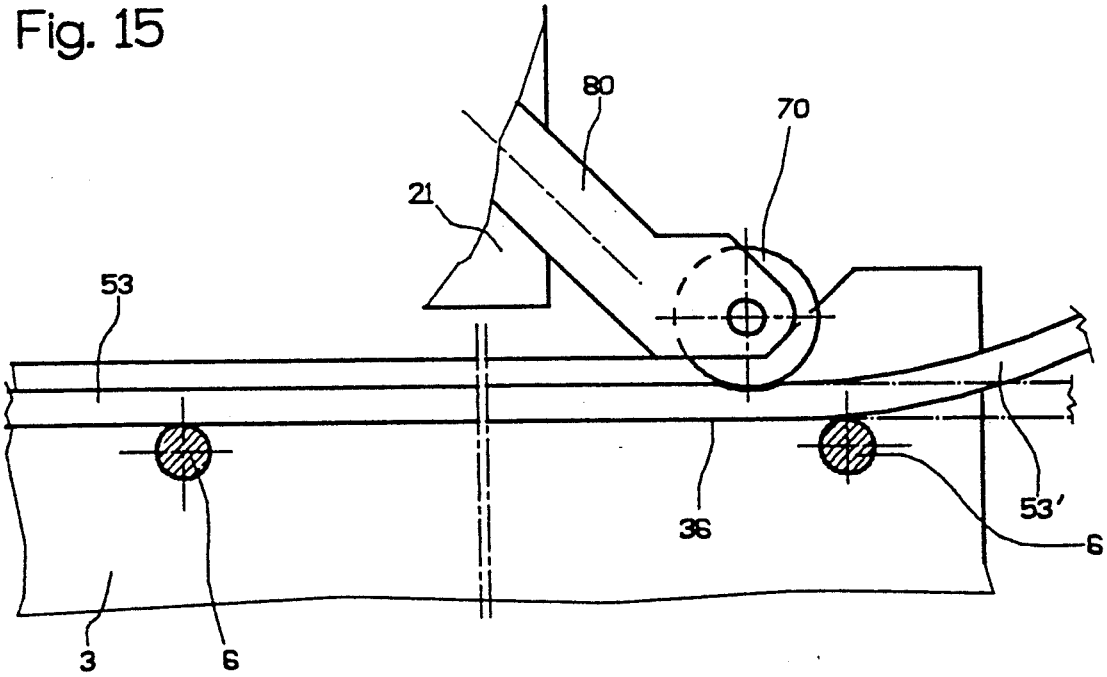
Figure 16:
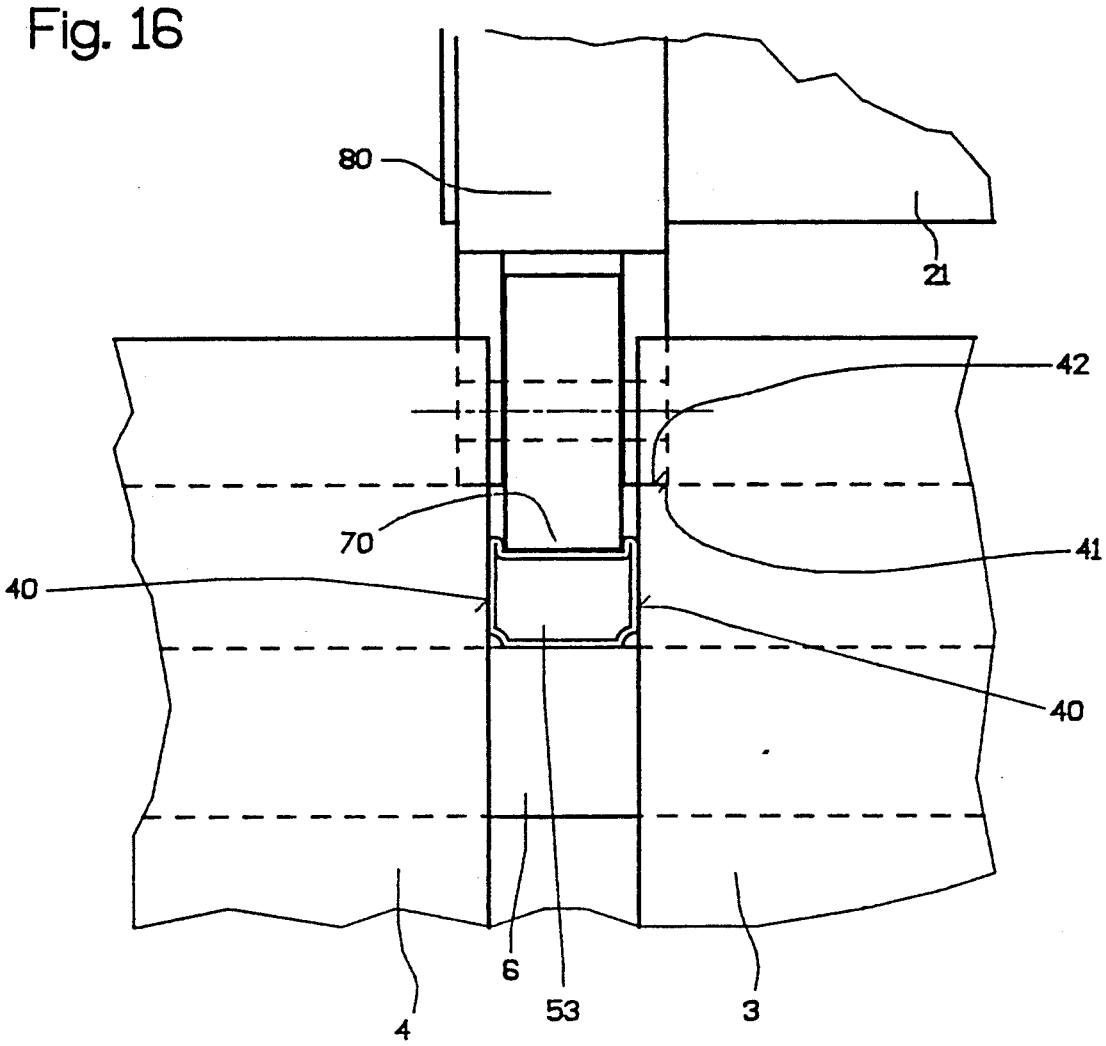
Figure 17:
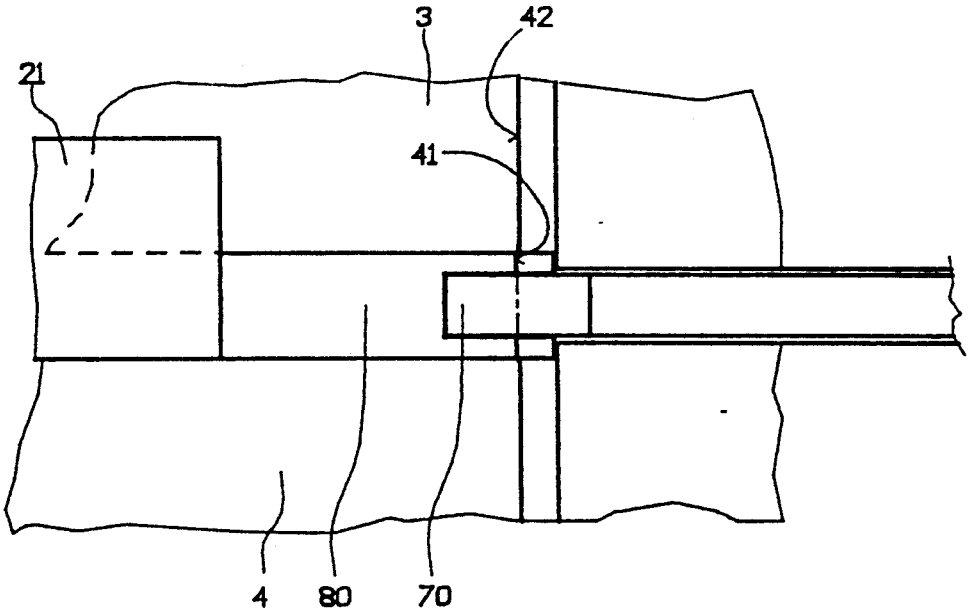
Figure 18:
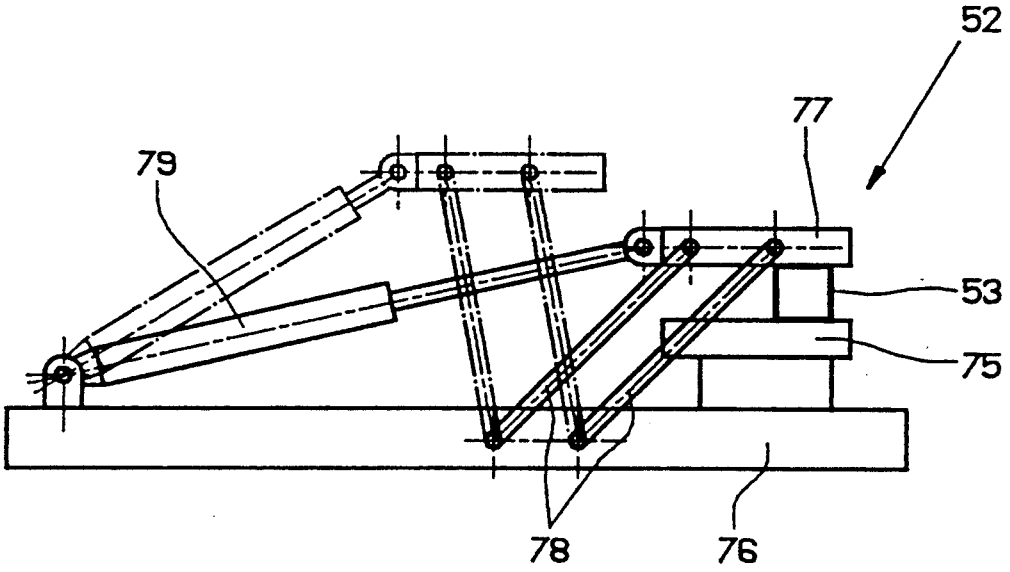
Figure 19:
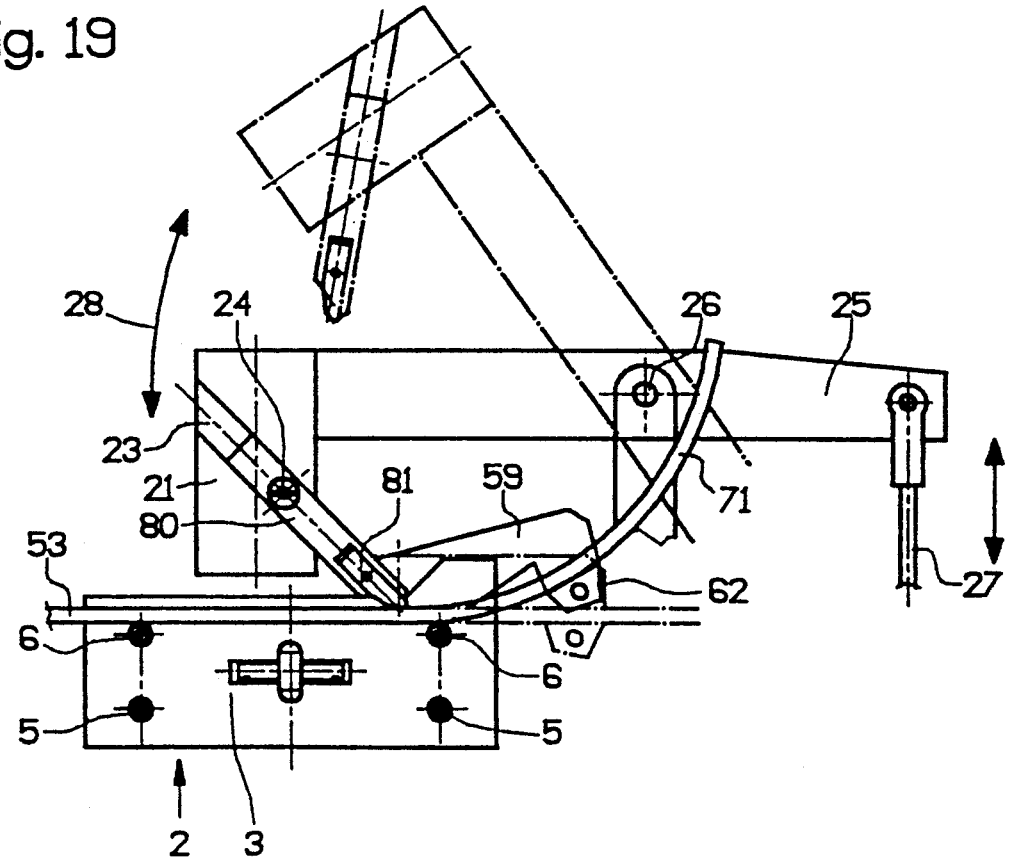
Figure 20:
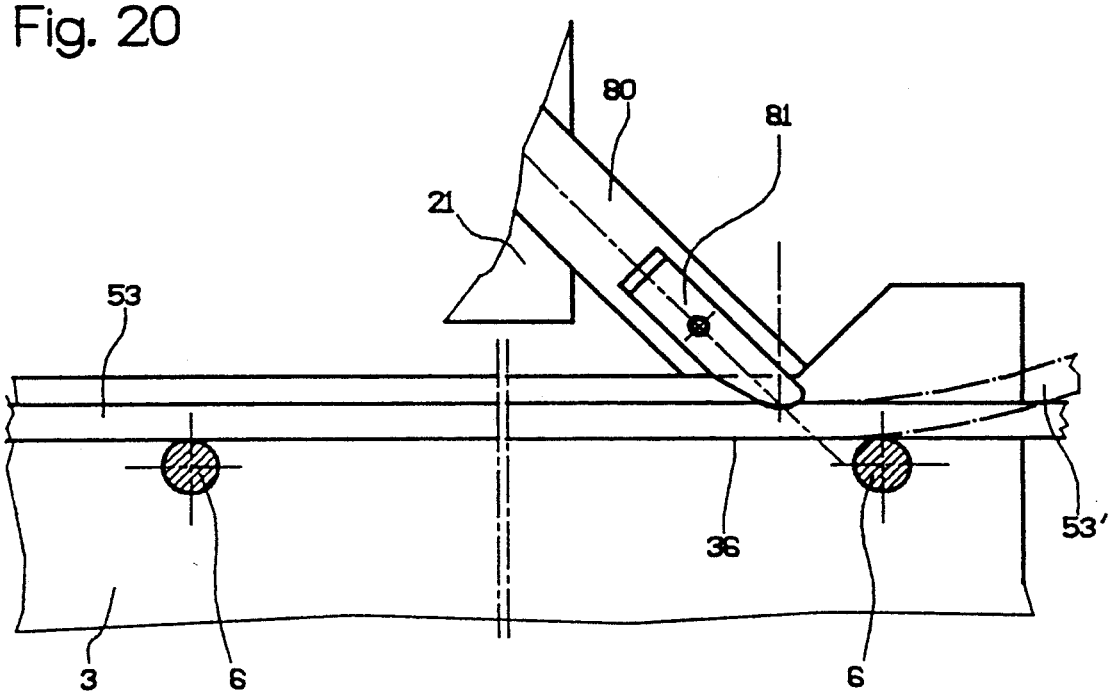
Figure 21:
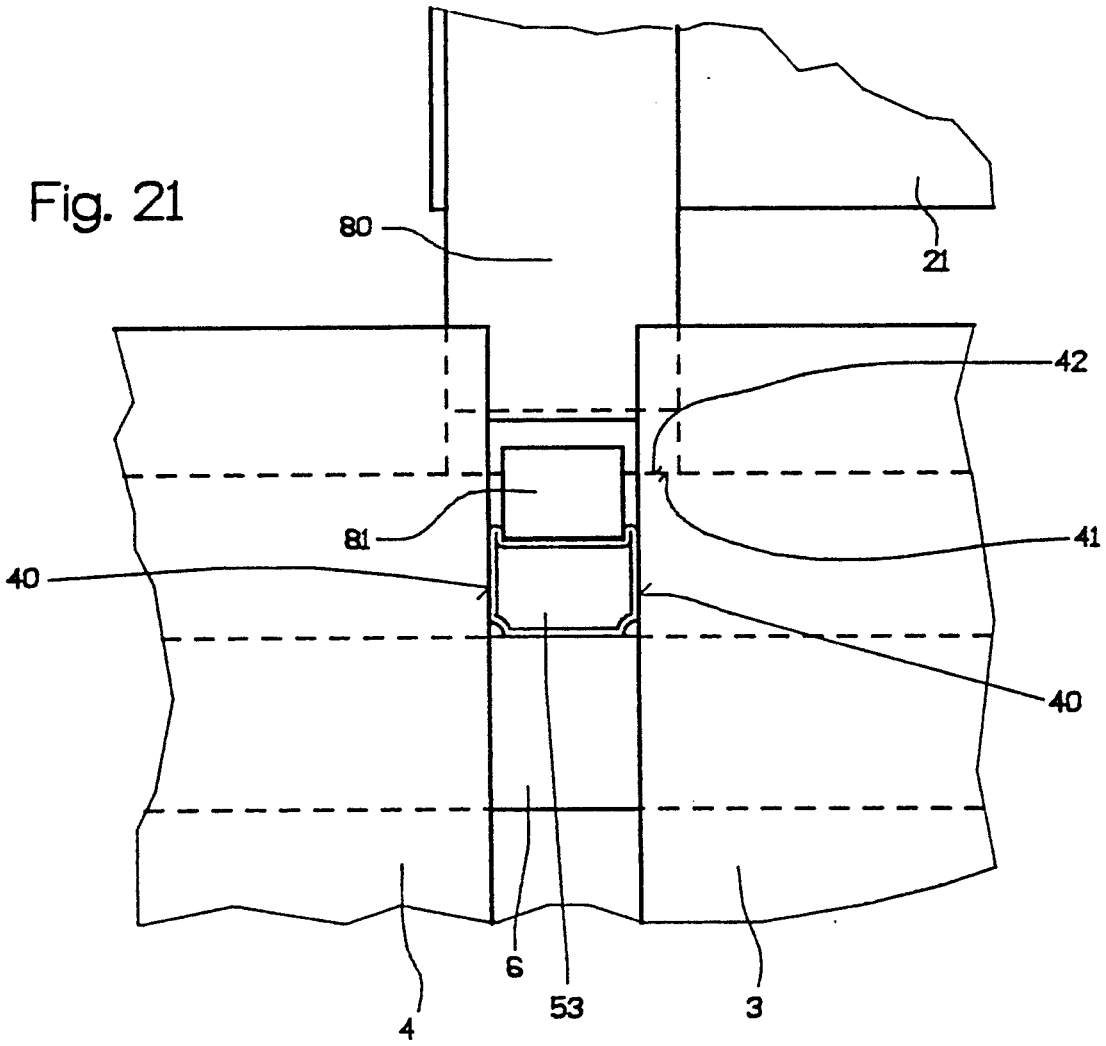
Figure 22:
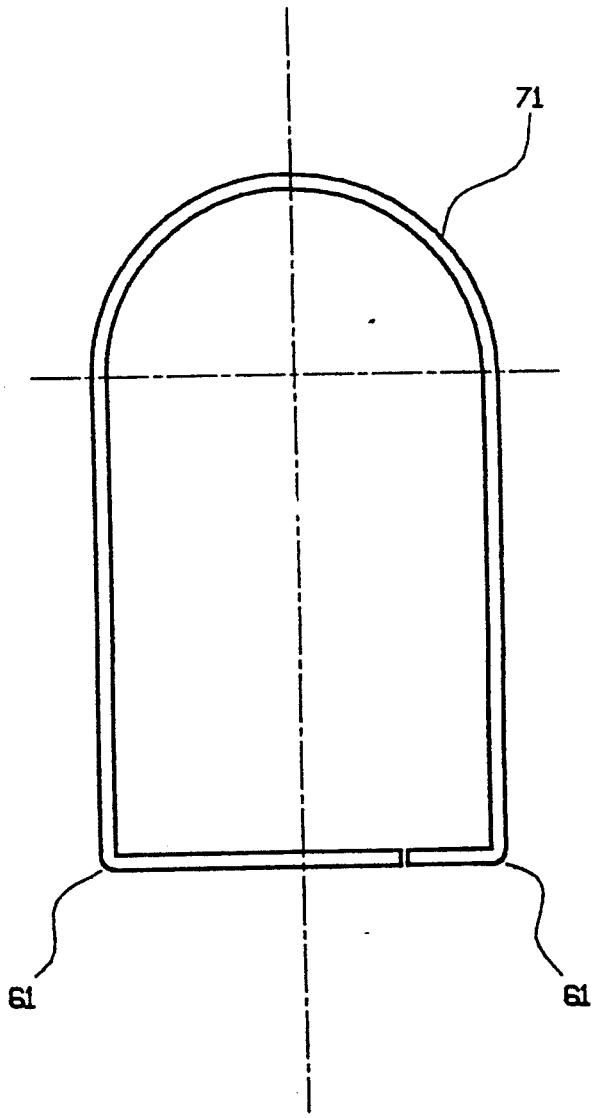

Additional details and features of the apparatus and of the process according to the invention and further advantages obtained thereby can be seen from the following description of embodiments illustrated in the drawings wherein:

FIG. 1 shows an apparatus for bending hollow profile strips into spacer frames, FIG. 2 shows the apparatus of FIG. 1 on an enlarged scale, FIG. 3 shows a bending head in a lateral view, FIG. 4 shows a bending head as seen from the left-hand side of FIG. 3, FIG. 5 shows a top view of the bending head, FIG. 6 shows a detail of the bending head in the zone of the bending abutment, FIG. 7 is a sectional view of the bending head, FIG. 8 shows an enlarged detail in the zone of the abutment, FIGS. 9*a*–9*f* are schematic views of individual stages of the operation of the apparatus according to FIGS. 1–8, FIG. 10 shows an apparatus for curving hollow profile strips, FIG. 11 shows the apparatus of FIG. 10 on an enlarged scale, FIG. 12 shows the tool used for curving the hollow profile strip, in a lateral view, FIG. 13 shows the tool as seen from the left-hand side of FIG. 12, FIG. 14 shows, a detail of the tool, FIG. 15 shows a section through the tool, FIGS. 16 and 17 show further details of the tool, FIG. 18 shows an embodiment of the gripper for advancing the hollow profile strip, FIG. 19 shows another embodiment of the tool of FIG. 12, FIG. 20 shows an enlarged view of the tool of FIG. 19, FIG. 21 shows an enlarged view of the tool of FIG. 20 as seen from the right-hand side, and FIG. 22 shows a spacer frame with two corners and a curved section.

In an apparatus illustrated in FIGS. 1 and 2, a hollow profile strip 53 is transported on a conveyor route 54 arranged at the bottom end of a supporting wall 60 up to a stop 57 in the zone of a bending station 58/59. The stop 57 can also be arranged in front of the bending station, lowerable into the conveyor route. The stop 57 can be equipped with a switch arresting the feeding conveyor (not shown) and triggering the seizing of the hollow profile strip 53 by the gripper 51. Thus, the hollow profile strip 53 is seized by the gripper 51 in an exactly defined position.

The section 53', transported past the bending station 58/59, of the hollow profile strip 53 is bent while being in contact with the supporting wall 60 by the bending lever 59 about ab abutment 58. The bending station is preferably of the construction described below with reference to FIGS. 3–8.

The apparatus can otherwise have the structure, for example, known from German Utility Model 8,705,796, and can comprise a supporting finger (indicated in FIG. 9) as also provided in the known apparatus.

The apparatus for bending hollow profile strips 53 illustrated in FIGS. 3 through 8 consists of a clamp 2 with a fixed clamping jaw 3 and a clamping jaw 4 movable with respect to the former jaw (FIG. 3 does not show the clamping jaw 4). The movable clamping jaw 4 can be displaced by way of guide pins 5 and 6, each of which are arranged in pairs, in the direction of double arrow 7, so that the opening width of the clamp 2 can be adapted to the breadth of the hollow profile strip 53 to be bent.

A lever 8, pivotably supported at the fixed clamping jaw 3, is provided for operating the movable clamping jaw 4 in the direction of arrow 7 (FIG. 4). The lever 8 is coupled via a tie rod 9 which is supported by way of a bearing 10 in a pivotably movable fashion at the movable clamping jaw 4. The pivot lever 8 is operated by means of a linear motor, not shown, for example a dual-acting pressure medium cylinder.

The bending apparatus furthermore includes a hold-down 20 serving as an abutment during the bending step. The hold-down 20 is exchangeably inserted in a support 21. For this purpose, a groove 23 is recessed in the support 21; the hold-down 20 can be inserted in this groove with a sliding fit and is retained by a screw 24, for example.

The support 21 for the hold-down 20 is mounted to a lever 25 which latter is pivotable about a bearing 26 affixed to the machine frame, i.e. a bearing immovable with respect to the fixed clamping jaw 3 of the clamp 2, in the direction of double arrow 28 from the operative position illustrated in solid lines in FIG. 3 into the ready position shown in dot-dash lines in FIG. 3, with the aid of a linear motor 27, for example a dual-acting pressure medium cylinder.

In addition, the support 21 for the hold-down 20 is adjustable perpendicularly to the plane of symmetry of the clamp 2, as shown in FIG. 4, namely in the direction of double arrow 29 illustrated in FIG. 4. For this purpose, the support 21 is displaceably guided via guide means 30 in a holder 31 connected with the lever 25. A linear motor, in the illustrated embodiment a dual-acting pressure medium cylinder 32, is provided for adjusting the support 21 and thus the hold-down 20 in the direction of double arrow 29; the piston rod 33 of this motor is coupled with the support 21 by way of a tie rod 34.

In this way, the hold-down 20 can not only be swung in a plane in parallel to the plane of symmetry of the clamp 2 (double arrow 28), but can also be adjusted in a direction perpendicular to the plane of symmetry of the clamp 2 (double arrow 29) so that the hold-down 20 can be moved in its entirety out of the bending zone.

As shown in FIGS. 3 and 4 and, in particular, in FIG. 6, the hold-down 20 carries at its front end, formed by two inclined surfaces 36 producing an acute angle to the longitudinal extension of the hold-down 20, a bead-like extension 35 which, as shown in FIG. 6, somewhat curves the upper surface of the hollow profile 53 clamped in the clamp 2 between the clamping jaws 3 and 4, still prior to the onset of the bending operation, when the hold-down 20 pivots into its operative position.

In addition, the provision is made in the bending apparatus of this invention that the forward end of the hold-down 20 and the bead-like extension 35 adjoining the oblique surfaces 36 at that location are fashioned to be somewhat narrower than the inside spacing between the mutually facing surfaces of the clamping jaws 3 and 4 of the clamp 2. Thus, the sidewalls 40 of the hollow profile strip 53 to be bent are also supported from the inside during the bending operation, as indicated in the sectional view of FIG. 7. This is of importance, in particular, when bending hollow profile strips 53 into spacer frames for insulating glass panes since the width of the lateral surfaces 40 of the hollow profile strip 53 is not to be reduced at all, if possible, even in the corner zone, and these lateral surfaces 40, in the corner zone, are not to deviate toward the inside from the planes defined by the lateral surfaces 40 in the zone of the corner so that it is possible to apply the adhesive and caulking material, to be provided prior to assembly of the insulating glass panes on the lateral surfaces 40 of the spacer frame, over the full width also in the corner zone which is, as is known, of considerable importance for the leakproofness of insulating glass panes.

In order to correctly align the hold-down 20, especially its bead-like extension 35, with respect to the clamp 2 and thus with respect to the axis 37 (FIG. 5) about which the hollow profile strip 53 is bent, an angled stop surface 41 is provided at the hold-down 20 in the zone of its forward end on one side; this stop surface cooperates with a step 42 on the fixed clamping jaw 3. Once the stop surface 41 is in contact with the step 42 of the clamping jaw 3, the axis 37 of the bead-like extension 35, provided at the front end of the bending abutment 20, is correctly aligned.

The apparatus according to this invention for performing a bending operation further includes a bending lever 59 with a bending extension 62 pivotable about an axis congruent with the axis 37 of the bead 35 at the front end of the hold-down 20 when the latter is in its operative position (the surfaces 41 are in contact with the surfaces 42 of the clamping jaw 3). The pivoting range of the bending lever 59 is not restricted to the 90° illustrated in FIG. 3 but rather also exceeds this value so that after the pivoting step (arrow 28) and the lateral displacement (arrow 29) of the hold-down 20, it is even possible to make a bend with acute angles between the two legs of the hollow profile strip 53 adjoining the corner 61 produced in the hollow profile strip 53.

When using the apparatus for bending a hollow profile strip 53 into a corner 61, the clamp 2 is opened and the hollow profile strip 53 is placed on the upper guide pins 6 or is transported on the conveyor route 54 to the pins 6. After the clamp 2 has been closed, with the inner surfaces of the clamping jaws 3 and 4 then being in contact with the lateral surfaces 40, the hold-down 20 is moved into its operative position shown in FIGS. 3 and 6 and, during this step, produces a certain downward curve in the upwardly pointing wall of the hollow profile strip 53. Thereupon, the section 53' of the hollow profile strip 53 projecting out of the clamp 2 is pivoted by swinging the bending lever 59, with the formation of a corner 61. If the angle at the corner 61 is to be an acute one, the hold-down 20 is pivoted back and laterally retracted whereupon bending is continued to the desired angle.

When the bending of the corner 61 is complete, the bending lever 59 is pivoted back, the clamp 2 is opened, and the hollow profile strip 53 is advanced by the gripper 52 until the location of the hollow profile strip 53 where the next corner 61 is to be produced is correctly aligned with respect to the bending tool, and then, as described above, the subsequent corner 61 is bent into shape. This procedure is continued until a spacer frame having the desired number of corners 61—in most cases four—has been created by bending.

The feeding of the hollow profile strip 53 by means of the apparatus shown in FIGS. 1 and 2 proceeds as follows:

The hollow profile strip 53 transported by the conveyor route 54 at the lower rim of the supporting wall 60 travels to the end stop 57. The hollow profile strip 53 is thus in a "zero" position. At the same time, the gripper 52, mounted to the slide 51, retains the hollow profile strip 53 in its position. The stop 57 is then lowered into the conveyor route 54, and the slide 51 with the profile 53 clamped in place by the gripper 52 moves then in the direction of the bending lever 59 exactly by that path increment predetermined by a process computer and corresponding to the length of the frame leg. The effectively traversed length is determined by an incremental generator 56. Once the slide 51 has reached the end point of its predetermined and effectively measured movement, the bending lever 59 bends the section 53' projecting along the rearwardly inclined supporting wall 60 upwardly by the angle predetermined by a process computer.

An incremental generator 56 determines the exact measurement of the path length traversed by the slide 51, and the movement of the slide 51 is controlled by way of this generator. The incremental generator 56 is mounted to the drive motor 55 or to the moving means 54 for the slide 51.

The slide 51 is driven, for example, by an endless toothed belt and is guided on a guide means extending in parallel to the conveyor route 54.

The engagement of the toothed belt into the drive gear wheel of the drive motor 55 is exact and without play so that even an incremental generator 56 mounted directly to the motor-gear unit can accurately record the traversed path length of the slide 51. The distance the slide 51 is to travel effectively corresponds to the profile length determined by the process computer for a bending operation.

The use of a toothed rack mounted to the guide means of the slide 51 is also just as advantageous. In this alternatively usable device, the drive motor 55 need not be fixedly mounted but rather can also be arranged at the slide 51. The drive gear wheel of the drive motor 55 then engages into the toothed rack attached at the guide means 54 of the slide 51; in this arrangement, an incremental generator 56 can likewise be mounted to the drive motor 55 or to the slide 51.

While the bending lever 59 bends the hollow profile strip 53 at an angle and the profile strip is held by the jaws 3 and 4, the gripper 52 mounted to the slide 51 is released. The slide 51 then travels at a high speed back into the starting position (reference point). Then the gripper 52 again seizes the hollow profile strip 53, and the slide 51, after the bending step, again advances exactly by the path length predetermined by the process computer, thus feeding the hollow profile strip 53 without slippage.

In case the hollow profile strip 53 is fed into the apparatus by a feeding device connected in front thereof up to the stop 57, the conveyor route 54 can be a simple slideway.

The sequence of the operating steps during the manufacture of a rectangular spacer frame will be described in greater detail below by way of example, with reference to FIG. 9:

A hollow profile strip 53 is advanced by a conveying means which can be, for example, the slide 51 with the gripper 52, starting, for example, with the reference position determined by the stop 57, to such an extent that the section 53' of the hollow profile strip 53 projecting past the bending abutment 20 corresponds to the length of the first leg of the spacer frame to be produced, diminished by a specific distance "x". This position is shown in FIG. 9*b*. At this point, the jaws 3 and 4 come into contact with the hollow profile strip 53, and the slide 51 returns into its starting position illustrated in FIG. 9*a*. After this return movement of the slide 51 is completed, or still during this movement, the section 53' is bent in the upward direction about the hold-down 20 in the direction of the arrow in FIG. 9*b* by the bending lever 59. Once the bending step is done, the hollow profile strip 53 is released by the jaws 3 and 4, and the slide 51 advances into the position shown in FIG. 9*c*, with the gripper 52 being in engagement from both sides or from the top and bottom with the hollow profile strip 53, the gripper advancing the hollow profile strip 53 to such an extent that the next (second) site wherein a corner 61 is to be produced in the hollow profile strip 53 is aligned with respect to the hold-down 20. Now the jaws 3 and 4 are closed again and retain the hollow profile strip 53 fixedly without displacement, and the next (second) bending step is executed with the aid of the bending lever 59 while the slide 51 again returns into its starting position. After the second bending step is completed, the slide 51 moves forward, with the gripper 52 being in contact with the hollow profile strip 53, by a distance corresponding to the length of the subsequent leg of the spacer frame to be manufactured so that the next (third) bending site is aligned with respect to the hold-down 20. The clamping jaws 3 and 4 close again and retain the hollow profile strip 53 whereupon the third bending step is performed.

After the third bending step is finished, the jaws 3 and 4 are again released from the hollow profile strip 53, and the slide 51 moves again in the forward direction, with the gripper 52 in contact with the hollow profile strip 53, to such an extent that the next (fourth) bending site is exactly aligned with respect to the hold-down 20.

When manufacturing a rectangular spacer frame as illustrated in FIG. 9, this stroke corresponds exactly to the stroke prior to execution of the second bending step. After the advancement of the hollow profile strip 53 has been accomplished as described above and the next bending site (the fourth) has been aligned with respect to the hold-down 20, the jaws 3 and 4 are closed again and retain the hollow profile strip 53. Now the hollow profile strip 53 is cut off at the location denoted by arrow 170 (FIG. 9*e*). The length of the thus-obtained section of the hollow profile strip 53, located to the left of the hold-down 20 in FIG. 9*e*, corresponds exactly to the predetermined distance "x" by which the hollow profile strip 53 had been advanced less far than corresponds to the length of the first leg (FIG. 9*b*) prior to the first bending step (FIG. 9*b*).

At this point the fourth bending step is performed; the front end 172 of the thus-fed hollow profile strip 53 and/or the section 173 of the partially completed spacer frame are deflected from the bending plane or the front end 172 is simply moved in the downward direction so that the fourth bending operation is not impeded.

After the fourth bending step is finished, the spacer frame, completed except for the connection of the two ends of the hollow profile strip 53 adjoining at the butt joint 171 (FIG. 9*f*), is transported out of the apparatus after the jaws 3 and 4 have been released again and the hold-down 20 has been removed from the bending plane. The ends of the hollow profile strip 53 bent into a spacer frame adjoining at the abutting site 171 are connected by inserting a connector or by butt welding. A welding device suitable for this purpose is known, for example, from EP-A-0,192,921.

If curved sections 71 are to be produced with the aid of the apparatus described in FIGS. 1 through 8 in hollow profile strips 53, a hold-down 80 is inserted in the support 21 of the tool, this hold-down carrying, at its free end facing the hollow profile strip 53, a freely rotatable roller 70 (FIGS. 10–17). By means of this roller 70, the hollow profile strip 53 guided between the jaws 3 and 4— i.e. the jaws 3 and 4 no longer clamp the hollow profile strip 53 in place—is retained against the guide rods 6 serving as the supporting means from below.

Particularly in case spacer frames are to be produced with at least one corner 61 and with at least one curved section 71 (compare FIG. 22), it is also possible to utilize a hold-down without a freely rotatable roller 70, i.e. a hold-down as illustrated in FIGS. 3–8, exhibiting at its front end an extension which is similar or identical to the extension 35 or which has a structure as described hereinbelow with reference to FIGS. 19–21.

The bending lever 59, when producing curved sections 71 in hollow profile strips 53, is oriented with respect to the conveying direction of the hollow profile strip 53 in correspondence with the desired radius of curvature at such an inclined position that the hollow profile strip 53 exiting from between the jaws 3 and 4 is deflected by the bending extension 62 at the bending lever 59 upwardly and, during this step, is continuously curved.

An essential prerequisite for a successful bending of the hollow profile strip 53 into a curved section 71 thereof resides in that this strip is advanced by the gripper 51 substantially continuously and exactly by the increment corresponding to the curved section 71 of the hollow profile strip 53.

The width of the roller 70, as shown especially in FIG. 16, is somewhat narrower than the breadth of the hollow profile strip 53 to be curved, so that the inner wall of the hollow profile strip 53, as can likewise be seen from FIG. 16, is deformed inwardly during the curving step. Thereby, the buckling of the inner wall of the hollow profile strip 53 is reduced so that an extensively smooth inner wall results in the curved section 71 of the hollow profile strip 53.

An especially advantageous embodiment of a gripper 51, ensuring the required frictional contact for the exact feeding of the hollow profile strip 53 to be curved, is shown in FIG. 18. It can be seen that the lower jaw 75 is rigidly connected to a slide 76 guided on at least one guide rail in the conveying direction, whereas the upper jaw 77 can be swung away with respect to the jaw 75 by way of parallelogram guide arms 78 by means of a pressure medium motor 79. The movable jaw 77 thus can be swung to behind the supporting wall 60 of the apparatus so that it does not interfere with the removal of a spacer frame that has finished its bending process.

As indicated already hereinabove, the stop 57 can be arranged, based on the conveying direction of the hollow profile strip 53, upstream of the tool with the hold-down 20 or 80 and the bending lever 59. Preferably, the stop 57 is equipped with a limit switch and is located, based on the conveying direction of the hollow profile strip 53, downstream of the end of the stroke of gripper 51 removed from the tool. In this way, a hollow profile strip 53 can be transported into the apparatus up to the stop 57 whereupon its switch is actuated and, controlled by a follow-up circuit, the gripper 51 takes over the hollow profile strip 53 in an exactly defined position.

It can be seen that it is possible, by exchanging the hold-down 80 with the roller 70 for the hold-down 20 of the embodiment shown in FIGS. 1-8, to produce spacer frames with at least one sharply bent corner with arbitrary angles between the legs of the spacer frame adjoining the corner 61, and with at least one curved section 71, from one and the same hollow profile strip 53.

In order to avoid tool change (exchange of the hold-down 80 with roller 70 for the hold-down 20 without a roller), a hold-down 80 as well as a hold-down 20 can be mounted to the support 21. These tools are then moved, as the case may be, into the operative position symmetrical to the jaws 3 and 4. This does not present any difficulties since the support 21, as described hereinabove with reference to FIGS. 1-8, can be lifted and is adjustable transversely to the bending plane.

The apparatus illustrated in FIGS. 19-21 corresponds essentially to the apparatus described in connection with FIGS. 10-17, except that a sliding member 81 is inserted in the hold-down 80 in place of the freely rotatable roller 70; this sliding member deforms the inside wall of the hollow profile strip 53 toward the inside during the curving step, as can be seen from FIG. 21.

The devices described in connection with FIGS. 10-21 can be designed, unless mentioned otherwise, in the same way as the apparatus described with reference to FIGS. 1-8, and also can be utilized as shown in FIG. 9.

The hold-down 80 with the roller 70, as well as the hold-down 20 with its extension 35 are adjustable in the conveying direction, i.e. in parallel to a plane connecting the guide pins 6. Thus, the position of the hold-downs can be adapted to the geometrical conditions resulting after changing the angular position of the lever 50 with the stop surface 62.

By means of the bending tool according to this invention, equipped with a hold-down 20 including extension 35 or with a hold-down 80 with extension 81, it is possible to bend hollow profile strips 53 also into spacer frames for insulating glass panes exhibiting at least one corner 61 angled in a sharp-edged fashion and at least one section 71 curved, for example, along a portion of a circular arc. One example of such a frame is illustrated in FIG. 22. The advantage, in this arrangement, resides in that it is possible to manufacture, by means of the apparatus according to this invention, insofar as the hold-down 20 with the extension 35 or the hold-down 80 with the extension 81 is utilized, even without a tool change sharp-edged corners—with the feed for the hollow profile strip 53 being at a standstill during the upward movement of the bending lever 59 while these corners are produced—as well as sections that are curved (in the shape of a circular arc)—with the feed for the hollow profile strip 53 being actuated while the bending lever 59 with the stop surface 62 is more or less extensively swung upwards.

What is claimed is:

1. In a process for the production of curved sections in hollow profile strips, comprising advancing a said strip supported from below under a hold-down between guide jaws, and deflecting the hollow profile strip, downstream of the hold-down, from the conveying direction of the hollow profile strip by means of an angularly positioned stationary stop surface along which the hollow profile strip slides during the entire step of producing the curved section; the improvement wherein said hollow profile strip is of rectangular cross sectional configuration, said hold-down contacting an adjacent side of said hollow profile strip across a width less than the width of said adjacent side thereby to deform a central portion of said adjacent side of said hollow profile strip inwardly towards the side of the strip opposite said adjacent side of the strip, and using for said deflecting a bending member spaced downstream from said hold-down and contacting the side of the strip opposite said adjacent side of the strip and bending the strip continuously about said hold-down as the strip passes said hold-down and said bending member thereby to impart to the strip a curvature that extends continuously from said hold-down to beyond said bending member with the deformed central portion extending along the inside of the curvature.

2. A process as claimed in claim 1, wherein said advancing of said strip is effected by gripping a portion of the strip by a gripper upstream of the hold-down, and advancing the gripper toward the hold-down while maintaining the strip gripped by the gripper during the entire step of producing the curved section.

3. A process as claimed in claim 1, and using as said hold-down a freely-rotating roller.

4. A process as claimed in claim 1, wherein said hollow profile strip is of rectangular cross sectional configuration and said guide jaws are stationary and flat and parallel to each other and slidingly contact opposite parallel sides of said hollow profile strip.

5. A process as claimed in claim 1, and subsequently imparting to said strip a right-angle bend spaced from said curved section.

* * * * *